US009251947B2

(12) United States Patent
Salomäki

(10) Patent No.: US 9,251,947 B2
(45) Date of Patent: Feb. 2, 2016

(54) LIQUID COOLING ARRANGEMENT OF AN INDUCTIVE COMPONENT AND A METHOD FOR MANUFACTURING AN INDUCTIVE COMPONENT

(75) Inventor: Jarkko Salomäki, Tuusula (FI)

(73) Assignee: FLEXGEN POWER SYSTEMS, INC., Houston, TX (US)

( * ) Notice: Subject to any disclaimer, the term of this patent is extended or adjusted under 35 U.S.C. 154(b) by 555 days.

(21) Appl. No.: 13/381,066

(22) PCT Filed: Jul. 2, 2010

(86) PCT No.: PCT/FI2010/050577

§ 371 (c)(1),
(2), (4) Date: Feb. 21, 2012

(87) PCT Pub. No.: WO2011/004068

PCT Pub. Date: Jan. 13, 2011

(65) Prior Publication Data

US 2012/0139683 A1 Jun. 7, 2012

(30) Foreign Application Priority Data

| | | |
|---|---|---|
| Jul. 7, 2009 | (FI) | 20095772 |
| Oct. 9, 2009 | (FI) | 20096045 |
| Apr. 15, 2010 | (FI) | 20105397 |

(51) Int. Cl.

| | |
|---|---|
| ***H01F 27/10*** | (2006.01) |
| ***H01F 27/08*** | (2006.01) |
| ***H01F 27/02*** | (2006.01) |
| ***H01F 27/26*** | (2006.01) |

(52) U.S. Cl.

CPC ..... *H01F 27/263* (2013.01); *H01F 27/10* (2013.01); *Y10T 29/4902* (2015.01)

(58) Field of Classification Search

USPC ..... 336/55, 57–61

See application file for complete search history.

(56) References Cited

U.S. PATENT DOCUMENTS

| | | | | |
|---|---|---|---|---|
| 2,547,045 | A * | 4/1951 | Sabol | 336/61 |
| 2,547,065 | A | 4/1951 | Wadhams | |
| 3,144,627 | A * | 8/1964 | Dunnabeck et al. | 336/55 |
| 3,183,461 | A | 5/1965 | Tipton | |
| 3,702,452 | A | 11/1972 | Yannucci | |
| 3,946,300 | A * | 3/1976 | Landis | 363/141 |
| 4,207,550 | A | 6/1980 | Daikoku et al. | |
| 4,577,175 | A * | 3/1986 | Burgher et al. | 336/61 |

(Continued)

FOREIGN PATENT DOCUMENTS

| | | | |
|---|---|---|---|
| JP | 60225409 A | * | 11/1985 |
| WO | WO 2008/104636 A1 | | 9/2008 |

*Primary Examiner* — Tsz Chan

(74) *Attorney, Agent, or Firm* — Myers Bigel Sibley & Sajovec, P.A.

(57) ABSTRACT

The object of the invention is a liquid cooling arrangement of an inductive component and a method for manufacturing the inductive component. The inductive component comprises at least a core (1) assembled from separate structural elements (7, 7*a*, 7*b*) as well as liquid cooling ducts (8*a*) integrated into the core (1) for the purpose of liquid cooling and a winding structure (3) around the core (1). The core (1) is assembled from subassemblies formed from structural elements (7, 7*a*, 7*b*), which subassemblies are separately composed of e.g. vertical pillars (35), a top horizontal beam (36) and a bottom horizontal beam (37), and cooling liquid ducts (8*a*) or cooling liquid pipes (10) are placed in at least a part of the subassemblies before final assembly of the core (1).

20 Claims, 12 Drawing Sheets

(56) References Cited

U.S. PATENT DOCUMENTS

Figure 1:
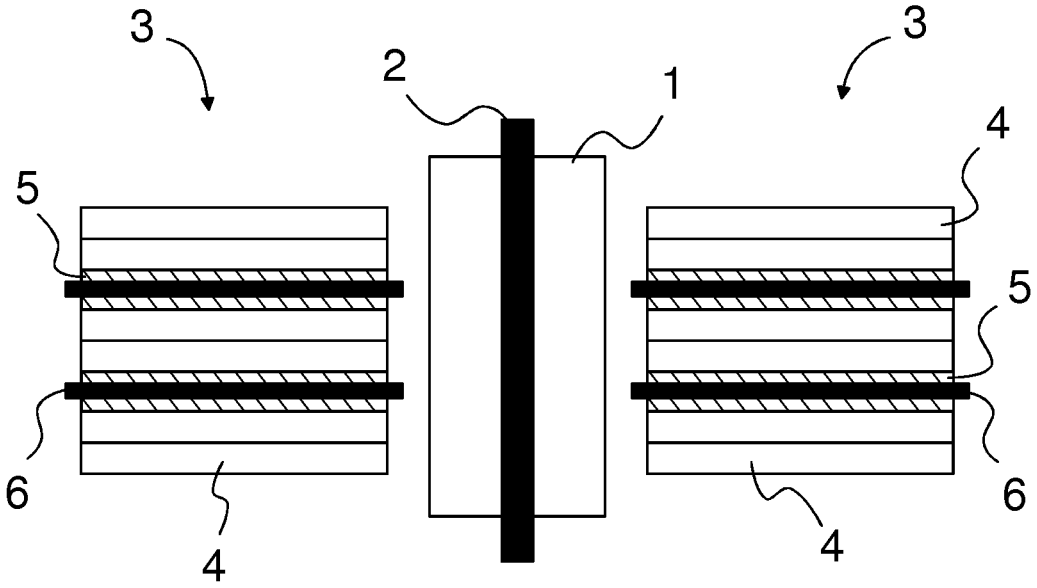

| | | | | | |
|---|---|---|---|---|---|
| 4,956,626 | A | * | 9/1990 | Hoppe et al. | 336/60 |
| 5,220,297 | A | * | 6/1993 | Crowhurst | 333/32 |
| 5,438,182 | A | * | 8/1995 | Choi | 219/702 |
| 5,682,292 | A | * | 10/1997 | Salanki | 361/699 |
| 5,815,062 | A | * | 9/1998 | Koyuhara et al. | 336/233 |
| 5,973,583 | A | | 10/1999 | Watanabe et al. | |
| RE36,787 | E | * | 7/2000 | Hansen et al. | 219/632 |
| 2007/0295715 | A1 | * | 12/2007 | Saka et al. | 219/624 |

* cited by examiner

LIQUID COOLING ARRANGEMENT OF AN INDUCTIVE COMPONENT AND A METHOD FOR MANUFACTURING AN INDUCTIVE COMPONENT

The object of the invention is a liquid cooling arrangement of an inductive component and a method for manufacturing the aforementioned inductive component as defined in the claims.

Liquid cooling has brought numerous advantages to power electronics, such as reduced temperatures and a smaller size. However, the implementation of liquid cooling has mainly focused on the cooling of power semiconductors, and not many very effective solutions have been developed for the liquid cooling of inductive components. Inductive components, such as filters, transformers and chokes, are composed of, among other things, a core and one or more windings, in both of which losses are created that must be cooled.

In the most common inductive components, various heat exchangers are placed only on the surface. A drawback in this methodology, however, is that not very effective cooling is achieved, but instead the structure is large in size and does not cool evenly. In this case hot spots remain in the structure and a large part of the losses is transferred to the surrounding air, which detrimentally heats the component cubicle, among other things, and the losses are thus not effectively transferred into the cooling liquid.

The aim of this invention is to eliminate the aforementioned drawbacks and to achieve a simple, advantageous and efficient liquid cooling structure of inductive components and also a method for manufacturing a liquid cooling structure for inductive components. The cooling solution according to the invention can be used for cooling all types of inductive components, but it is particularly well suited to the cooling of chokes.

Other inventive embodiments may also be discussed in the descriptive section of the present application. The inventive content of the application can also be defined differently than in the claims presented below. In addition, it can be stated that at least some of the features of the subordinate claims can at least in some suitable situations be deemed to be inventive in their own right.

One advantage, among others, of the solution according to the invention is that the loss produced in the core of the inductive component can be efficiently transferred into the cooling liquid. Another advantage is that the losses of the winding can be transferred into the cooling liquid also via the cores such that the losses are conducted from the winding directly into the cores through an insulation. A further advantage is that the solution according to the invention improves the efficiency of the liquid cooling of inductive components.

Figure 2:
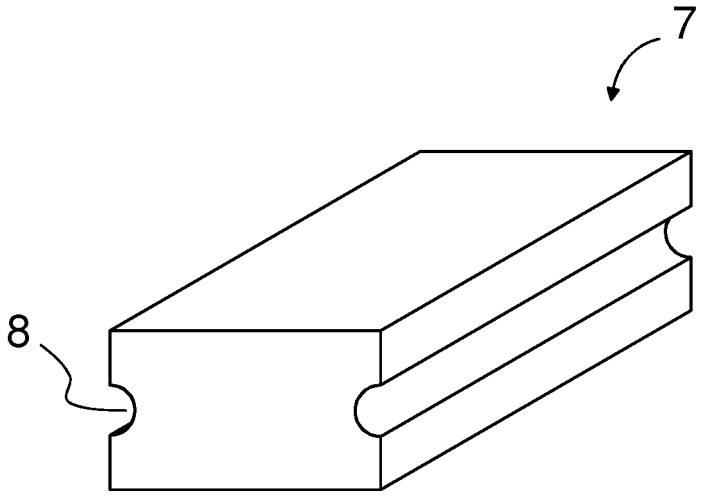
Figure 3:
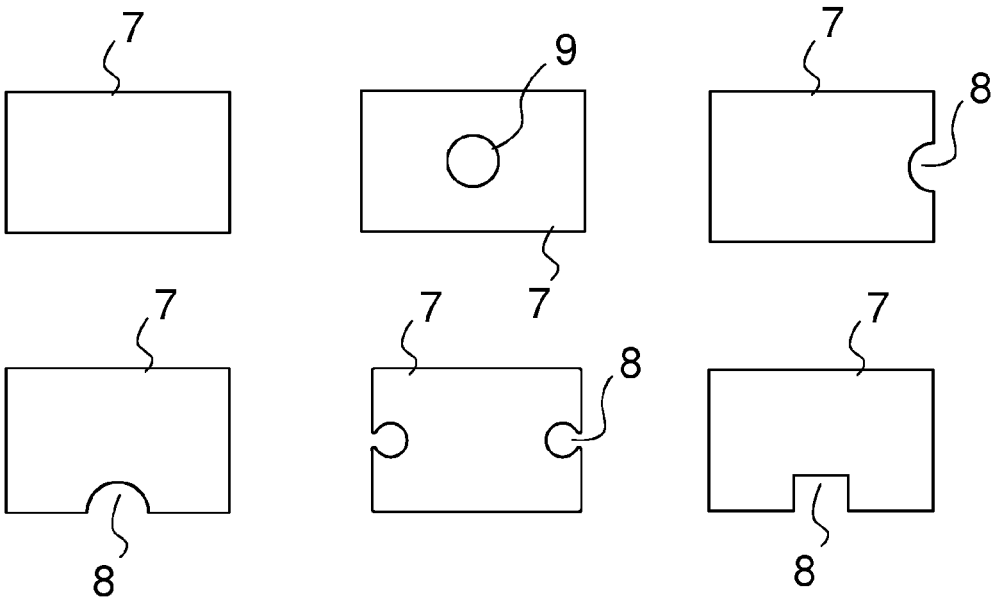
Figure 4:
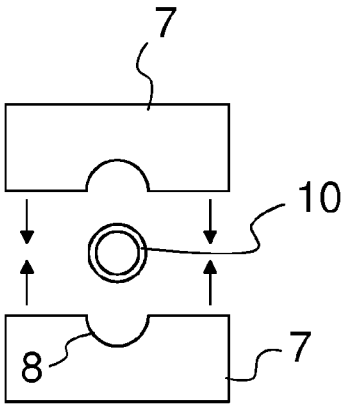
Figure 5:
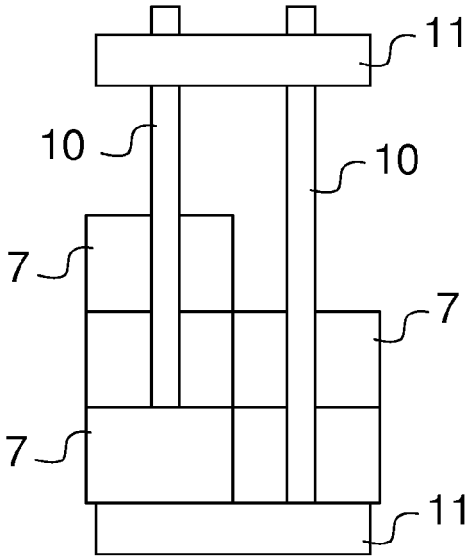
Figure 6:
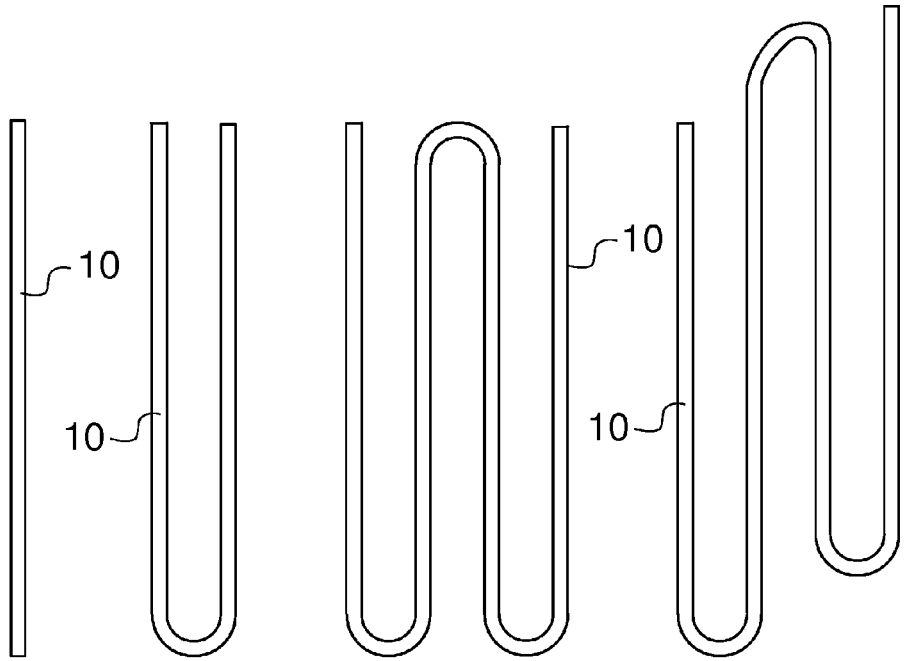
Figure 7:
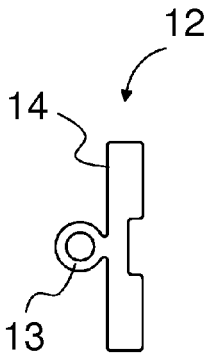
Figure 8:
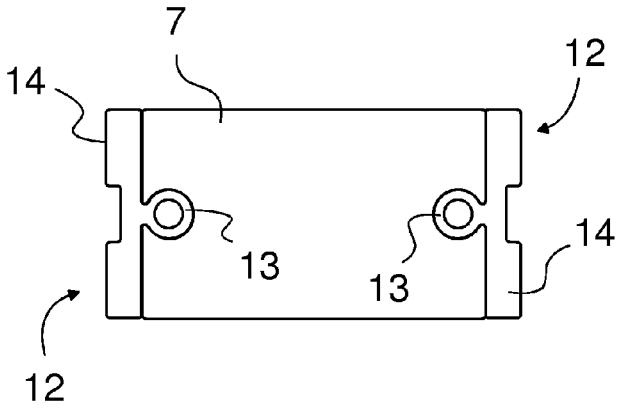
Figure 9:
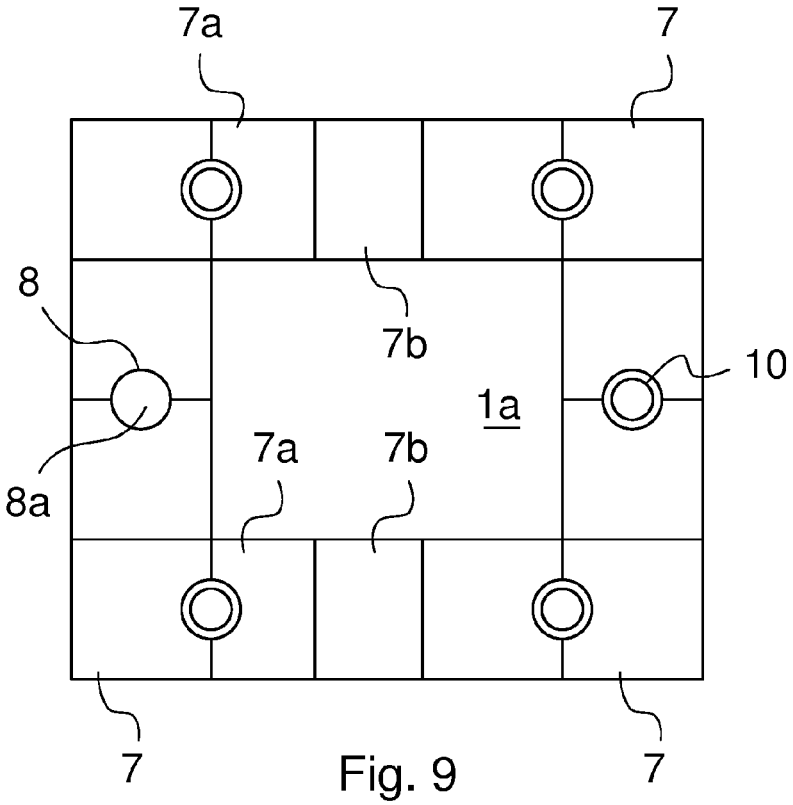
Figure 10:
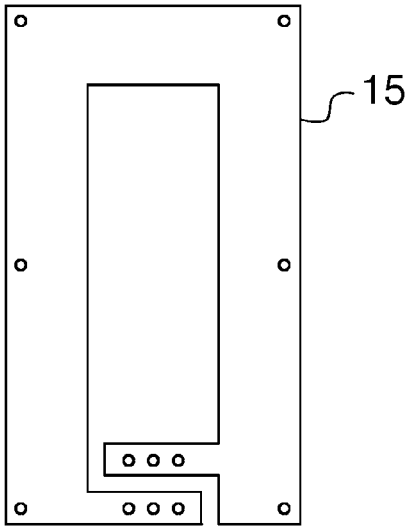
Figure 11:
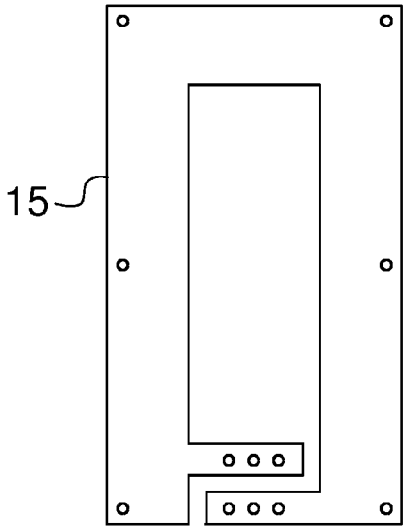
Figure 12:
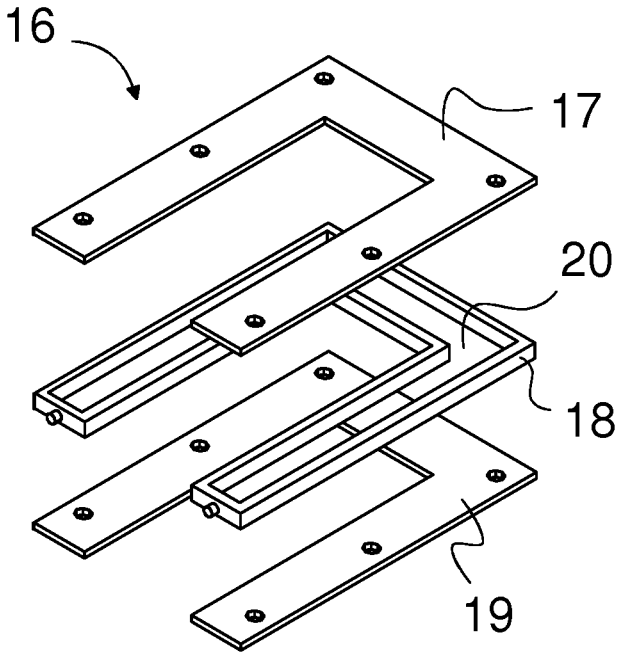
Figure 13:
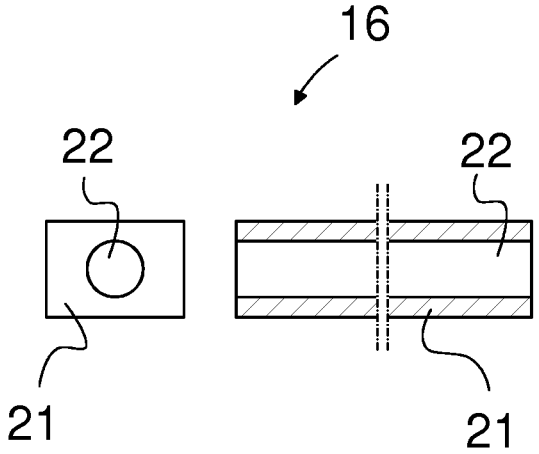
Figure 14:
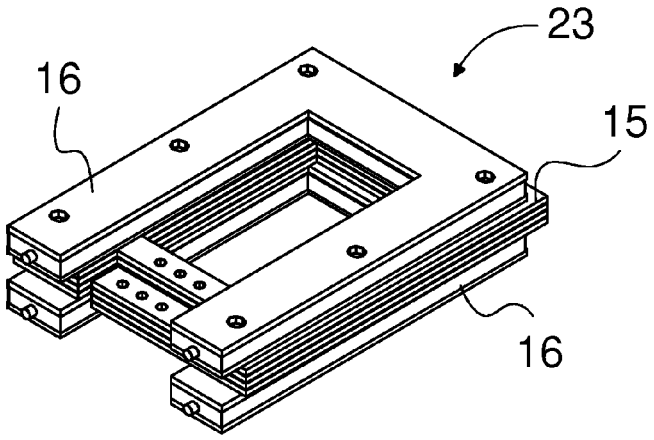
Figure 15:
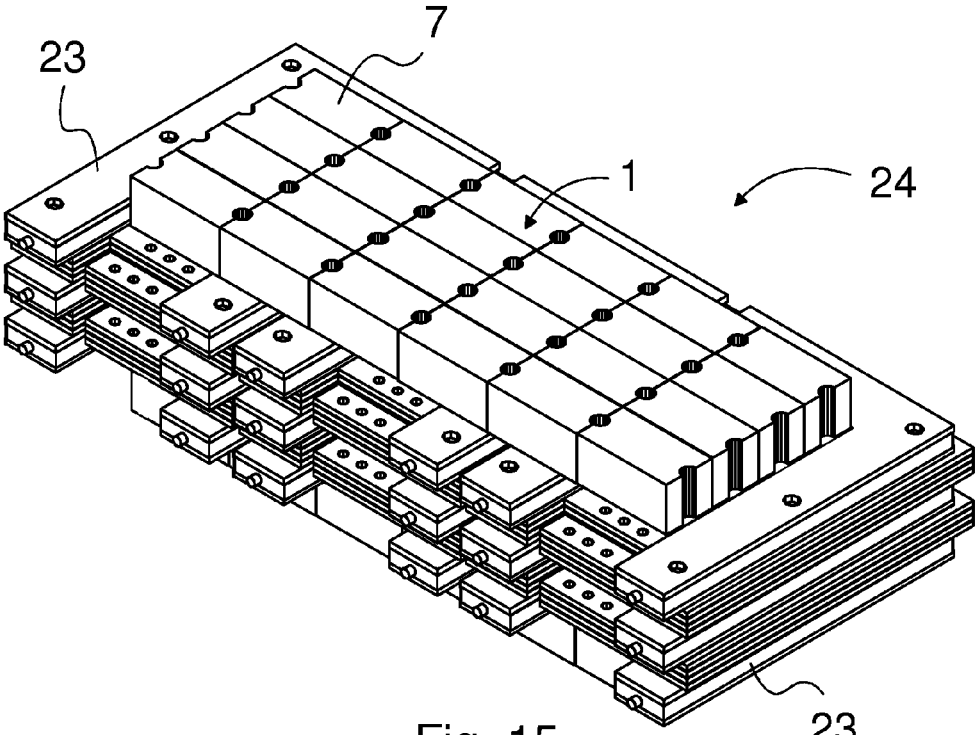

In the following, the invention will be described in greater detail by the aid of some examples of its embodiments with reference to the attached drawings, wherein FIG. 1 presents the main concept of the idea according to the invention in diagrammatic and simplified form, FIG. 2 presents an oblique top view of one structural element of a core according to the invention, FIG. 3 presents an end view of various structural elements of a core according to the invention, FIG. 4 presents a simplified end view of two structural elements of a core according to the invention, around a cooling liquid pipe, FIG. 5 presents a simplified top view of one core of an inductive component according to the invention in the assembly phase, FIG. 6 presents a simplified top view of various cooling pipe solutions according to the invention, FIG. 7 presents a simplified end view of one cooling pipe solution according to the invention, FIG. 8 presents an end view of a cooling pipe solution according to FIG. 7 installed in connection with the structural elements of the core, FIG. 9 presents a simplified end view of one solution according to the invention for implementing liquid cooling of a core, FIG. 10 presents a simplified top view of one winding plate intended for stacking, FIG. 11 presents a simplified top view of a winding plate that is a mirror image of the winding plate of FIG. 10, FIG. 12 presents an oblique and diagrammatic top view of one simplified liquid cooling structure according to the invention, FIG. 13 presents a diagrammatic, simplified and partially sectioned view of one further liquid cooling structure according to the invention, as viewed from the end and from the side, FIG. 14 presents a diagrammatic and simplified oblique top view of one partly assembled liquid cooling structure according to the invention, FIG. 15 presents a diagrammatic and simplified oblique top view of a choke assembled with the liquid-cooled winding structure according to FIG. 14.

Figure 16:
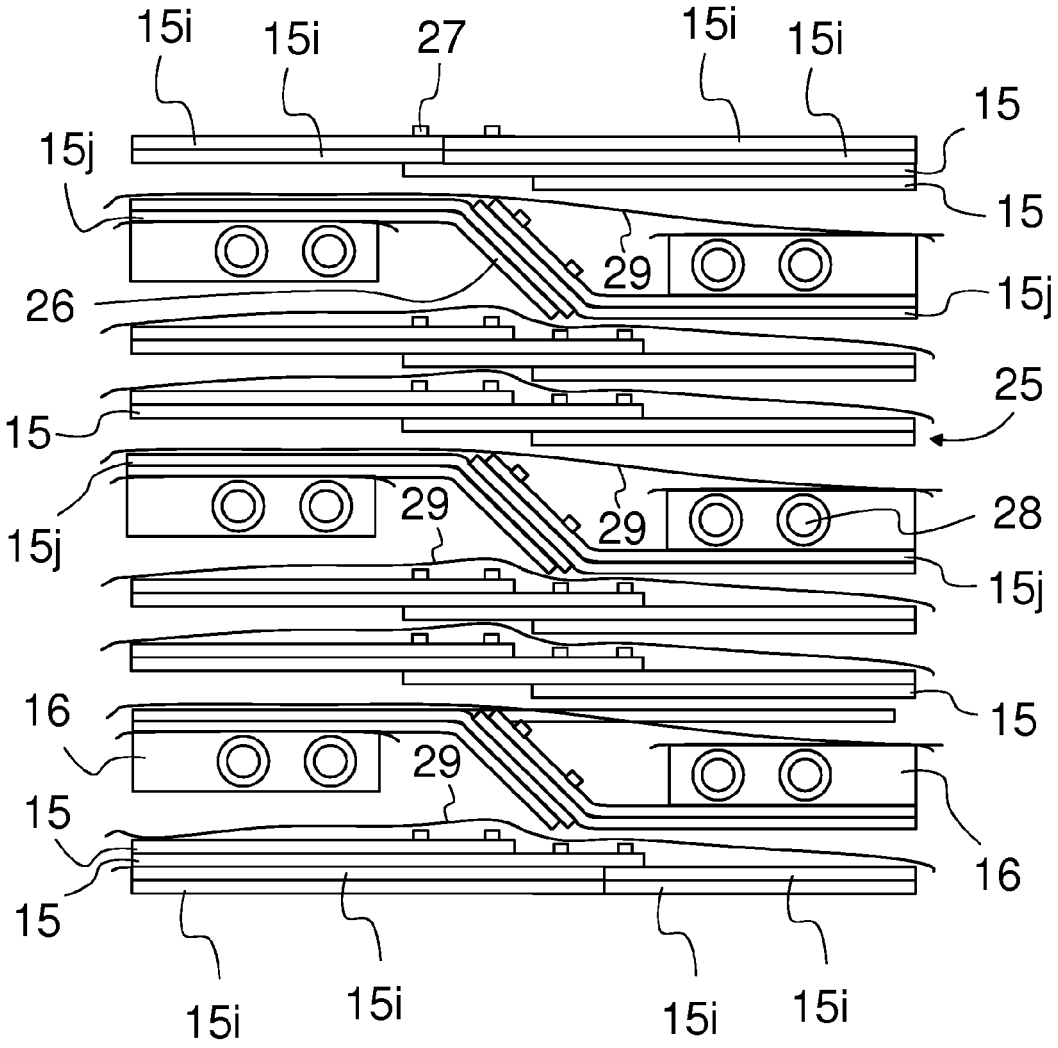
Figure 17:
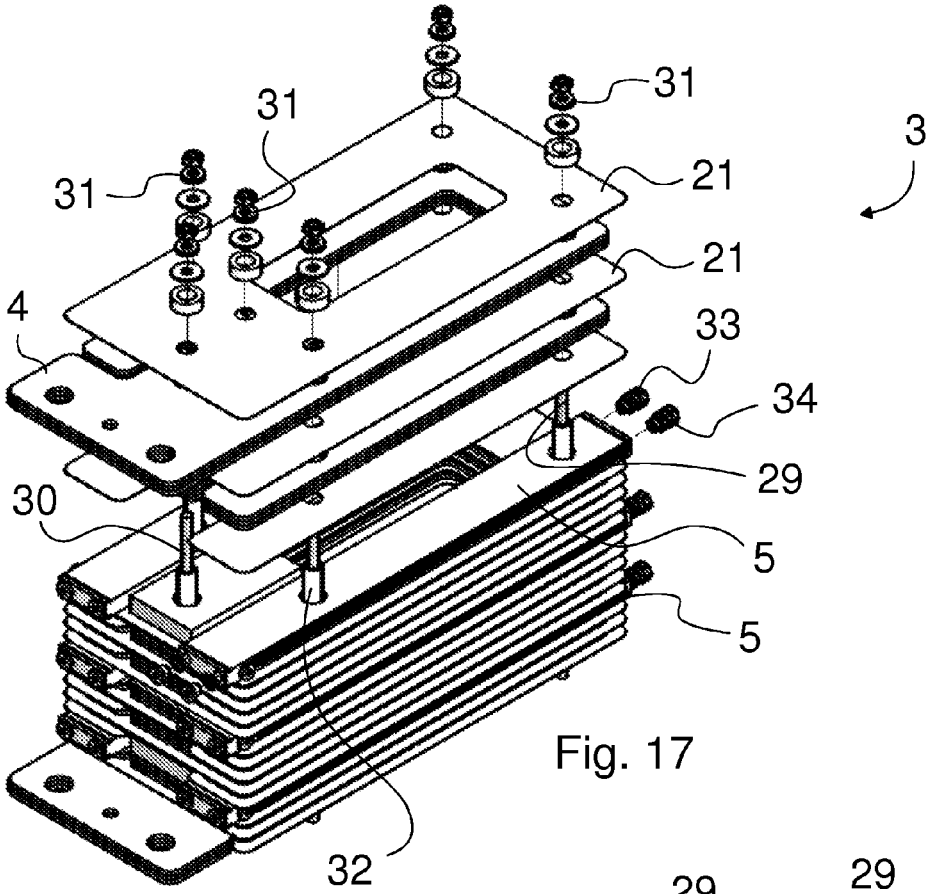
Figure 18:
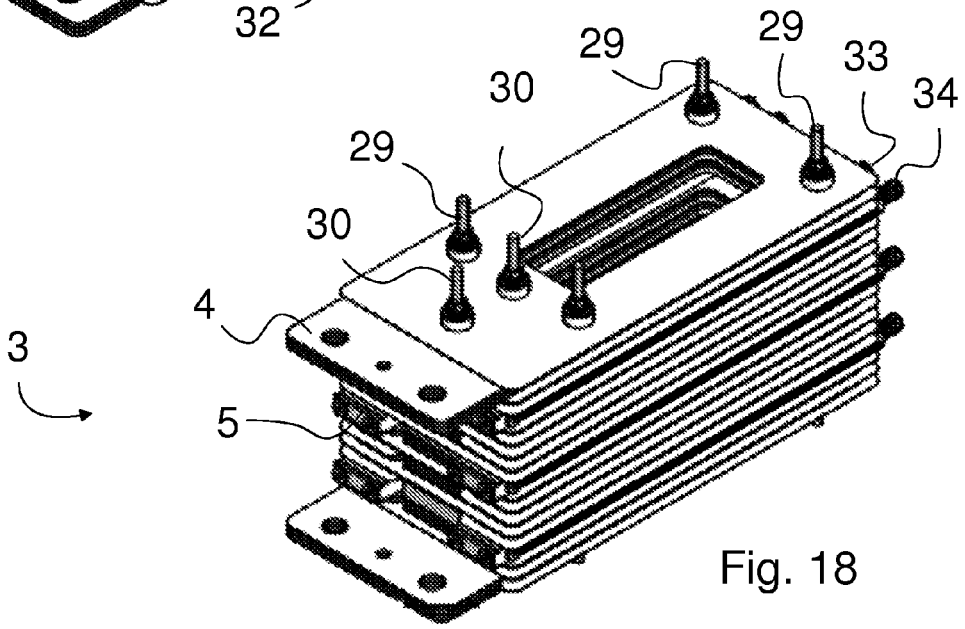
Figure 19:
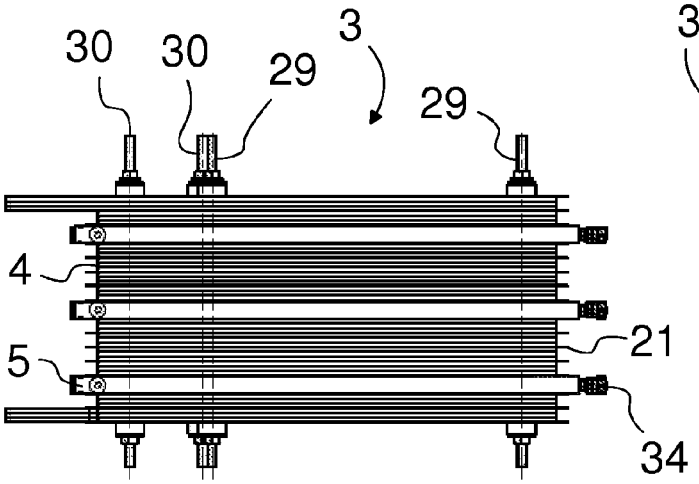
Figure 20:
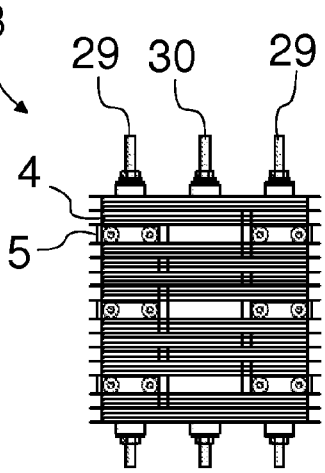
Figure 21:
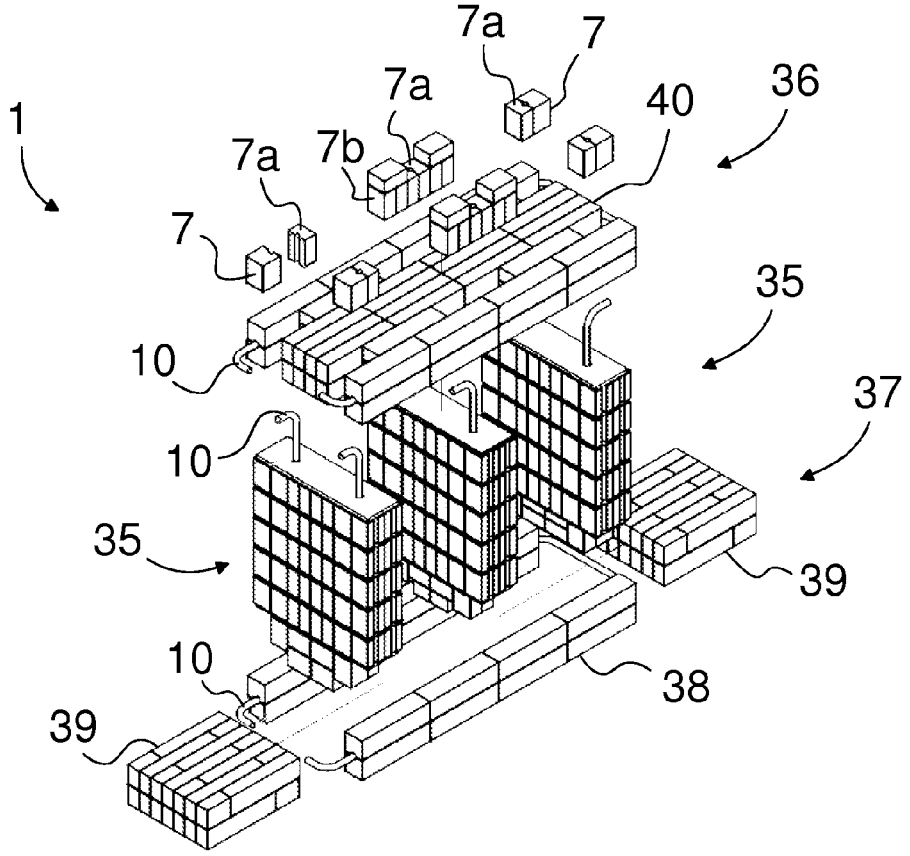
Figure 22:
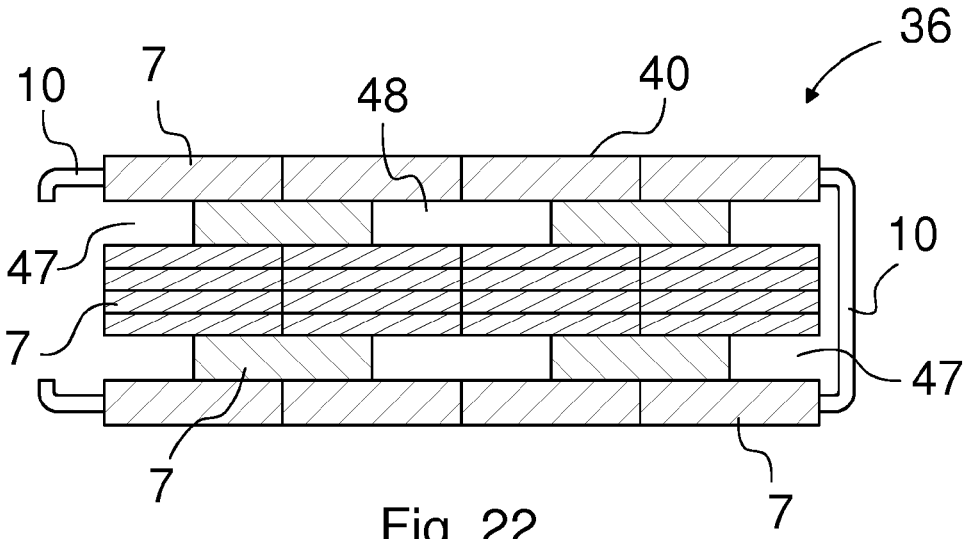
Figure 23:
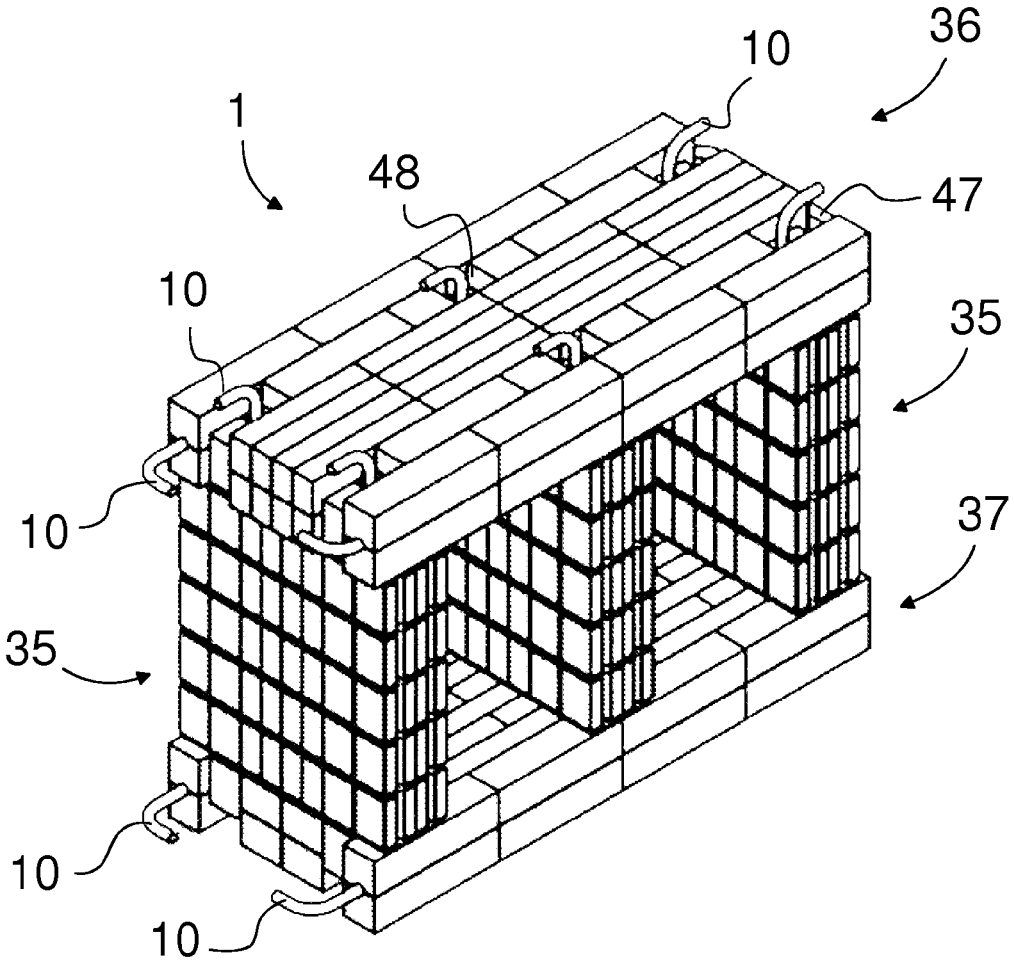
Figure 24:
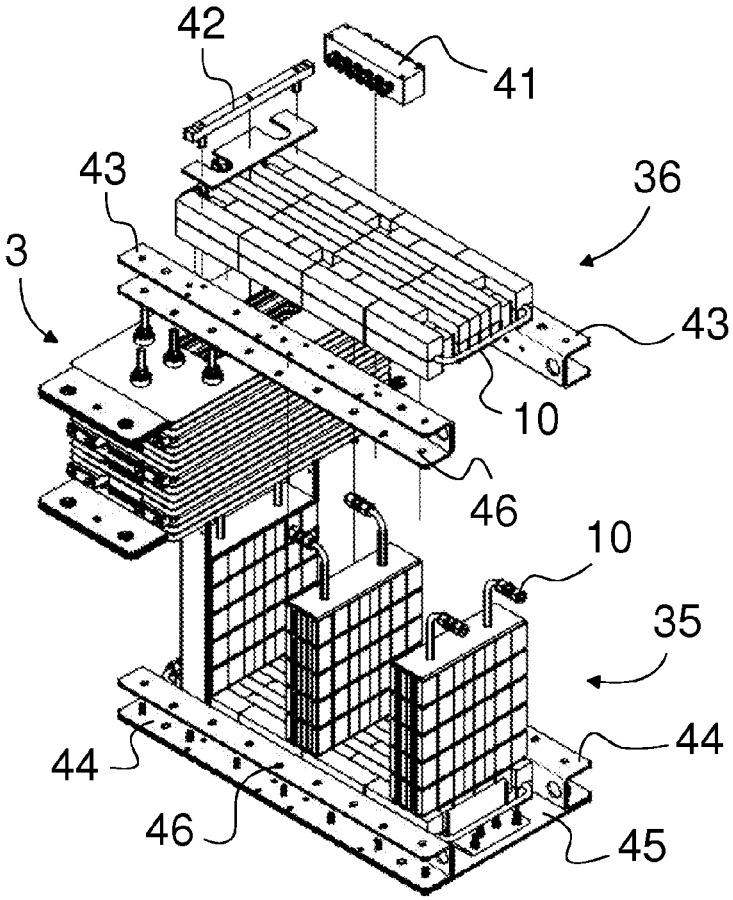
Figure 25:
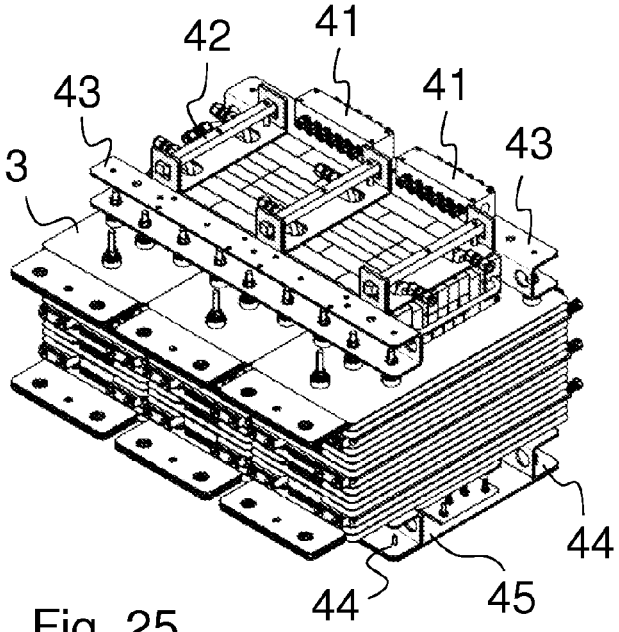
Figure 26:
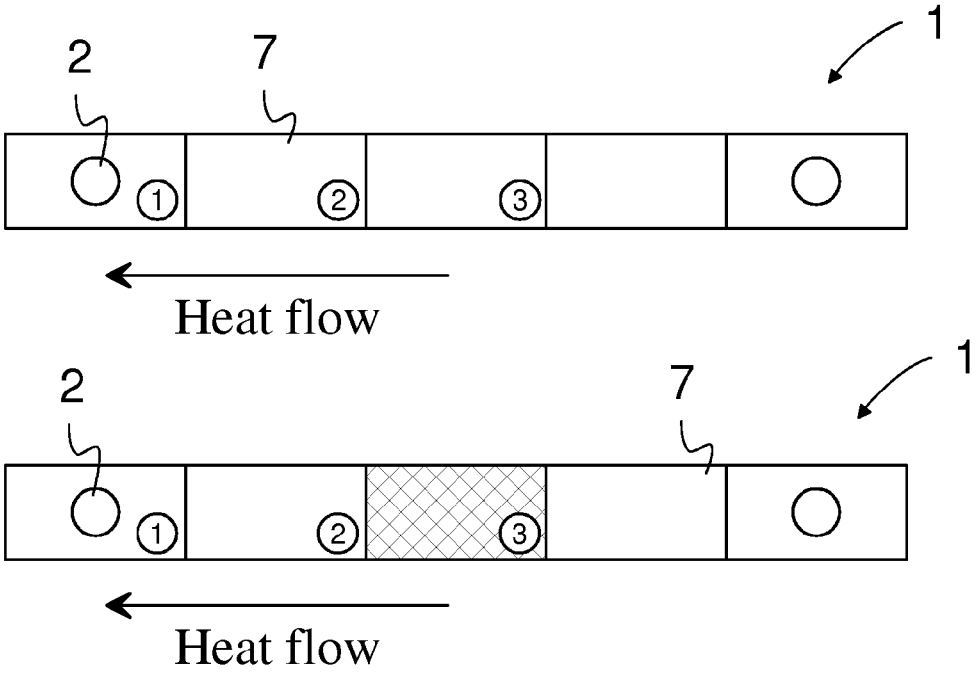
Figure 27:
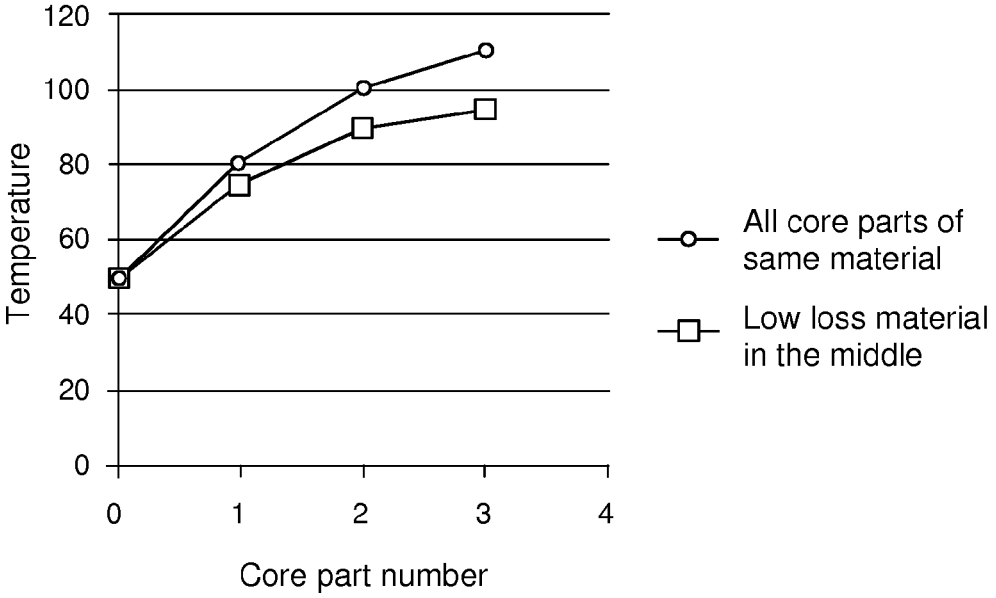

FIG. 16 presents a diagrammatic and simplified end view of a choke assembled with liquid cooling elements and a stacked winding structure, FIG. 17 presents an oblique top view of one winding structure of a choke according to the invention in the assembly phase of the winding, FIG. 18 presents a winding structure according to FIG. 17, assembled and viewed obliquely from above, FIG. 19 presents a winding structure according to FIG. 18, assembled and viewed from the side, FIG. 20 presents a winding structure according to FIG. 18, assembled and viewed from the end, FIG. 21 presents an oblique top view of one core structure of a 3-phase choke according to the invention in the assembly phase of the core, FIG. 22 presents a top view of one top beam of a core structure of a 3-phase choke according to the invention in the assembly phase, FIG. 23 presents a core structure of a 3-phase choke according to FIG. 21, assembled and viewed obliquely from above, FIG. 24 presents an oblique top view of one assembly phase of a 3-phase choke according to the invention, in which the winding structure and the core structure are connected to each other, FIG. 25 presents a 3-phase choke according to the invention, assembled and viewed obliquely from above, FIG. 26 presents a diagrammatic and simplified side or top view of two core structures assembled from different structural elements, and FIG. 27 presents the temperatures of the structural elements of FIG. 26 as a diagram.

FIG. 1 presents the main concept of the idea according to the invention in a diagrammatic and simplified form. The solution according to the invention is suited to improving the efficiency of the liquid cooling of inductive components, and more particularly of chokes. One idea of the invention is that efficiently functioning liquid cooling ducts 2 pass through the core 1 of an inductive component, such as a choke. In this way the loss produced in the core 1 can be efficiently transferred into the cooling liquid passing through the core 1. Likewise, liquid cooling elements 5 have been included in the winding 3 around the core 1, which liquid cooling elements comprise a set of cooling ducts 6, in which case also the winding losses are efficiently transferred into the cooling liquid. The winding 3 comprises e.g. plates 4 placed one on top of another, and liquid cooling elements 5 with cooling ducts 6 are fitted into the gaps between the plates 4.

Alternatively the winding can also be of the foil type, in which case liquid cooling is integrated into each or only into some of the gaps between the foil layers. A heat exchanger can be installed vertically between the foil layers or a liquid pouch that adapts along with the foil winding is installed on top of the winding foil before the winding, which liquid pouch remains between the foil winding layers and in which liquid pouch the cooling liquid flows. Alternatively the liquid cooling could also flow in ducts built inside or on the surface of the foil. The losses of the winding 3 can also be transferred into the liquid via the cores 1 such that the losses are conducted from the winding 3 into the cores 1 e.g. through an insulation. Correspondingly, the core 1 can be cooled into the winding 3. The cooling options presented above can be freely combined.

It is practical to manufacture the core 1 of the inductive component from a number of smaller structural elements 7 that are essentially mainly similar to each other. Metallurgical powder is particularly well suited to the manufacturing of this type of structural element 7. A structural element manufactured from metallurgical powder, i.e. metal powder, operates electrically just as well in all dimensional directions, i.e. in the X, Y and Z directions, in which case it can be installed three-dimensionally in all directions. The structure is appreciably better than a structure made of laminate that works well in only one or two-dimensional directions and badly in the third dimensional direction and therefore causes additional losses. The structural element 7 is preferably manufactured by compression from insulated metal powder. An additional advantage of a core pressed from insulated metal powder is that due to its internal insulation it withstands corrosion better than a core made of laminate.

FIGS. 2 and 3 present a simplified view of the structural elements 7 of a core, manufactured e.g. by pressing, that are used in the solution according to the invention. FIG. 2 presents an oblique top view of one structural element 7 and FIG. 3 presents some different models of structural elements as viewed directly from the end. The dimensions of a structural element and also the number, size, shape and positioning of the grooves 8 and holes 9 forming ducts can differ depending on the structural element. A structural element 7 can be of a solid rectangular polyhedron shape, in which each side surface is flat, or a structural element 7 can be otherwise like the rectangular polyhedron stated but the structural element comprises a hole 9 for the cooling pipe in the center, which hole is of the length of the structural element. The structural element 7 can also be of a different shape than a rectangular polyhedron. Instead of a hole 9, the structural element 7 can also comprise a groove 8, which is of a semicircular or rectangular cross-sectional shape or some other cross-sectional shape and of the length of the structural element, on one or more surfaces. There are thus no grooves 8 or holes 9 at all or one, two or more of them, and they are made in the structural element 7 in the pressing phase of the structural element.

By means of the groove 8, a duct is formed for a liquid cooling pipe, if necessary, by placing two structural elements 7 against each other such that the grooves 8 are also placed against each other. It is easier to install the liquid cooling pipe into this type of structure than into a hole 9. The duct formed by the grooves 8 is preferably larger to the extent of a suitable tolerance than the outside diameter of the liquid cooling pipe. The space between the pipe and the wall of the groove 8 is preferably filled with a thermally conductive paste. The task of the thermal paste is to ensure the transfer of heat from the core 1 into the liquid cooling pipe, and also to even out the effect of mechanical tolerances and thermal expansion. This type of thermal paste also forms an electrically insulating layer between the core 1 and the pipe, which reduces the formation of undesired currents into the structure.

From the viewpoint of assembly, one preferred structure of the core is such that the cooling liquid circulation with its pipes and end flanges is manufactured first and the cores are assembled from small structural elements 7 that comprise a suitable groove 8 ready for liquid pipes, by joining the structural elements 7 around the ready piping.

FIGS. 4 and 5 present one such structural option. FIG. 4 presents a simplified view of a cooling pipe 10 that forms a liquid cooling duct 2 of the core, below and above which pipe, or on both sides of the pipe, the structural elements 7 of the core 1 that are provided with a semicircular groove 8 at one of their sides are placed such that the pipe 10 is finally almost totally inside the structural elements 7. The aforementioned thermally conductive paste is preferably placed into the grooves 8 before placing the structural elements 7 around the pipes 10. In the assembly phase the structural elements 7 are glued together at their surfaces and ends that face each other.

FIG. 5 presents a simplified structure, in which a ready liquid circulation structure is first constructed by means of the end flanges 11 and the pipes 10, around which structure the structural elements 7 of the core are placed finally in the assembly phase of the core, which structural elements at the same time are placed around the pipes 10 and are glued to each other. The pipes 10 of one core are connected to each other with ducts that are in the end flanges 11 forming a continuous liquid circulation, which ducts are not shown in the figure. The pipes 10 can also be connected by means of hoses that are external to the core. By manufacturing the piping in this way first, the joints of the liquid circulation can be manufactured more freely, e.g. by laser welding or by casting. Likewise the liquid circulation can already be tested in an early phase. In FIG. 5 only some of the structural elements 7 of the core have been placed into position.

FIG. 6 presents in a simplified form various cooling pipe solutions according to the invention. The liquid cooling pipe 10 can be straight, or it can also be bent to form an elongated U-shape, in which case fewer connectors are needed than when two straight pipes are used and connected together. The pipe 10 can also have a number of bends at both ends. This type of structure is presented as the third pipe structure from the left in FIG. 6. The structure on the right-hand side in FIG. 6 presents a liquid cooling pipe 10, which comprises bends in a number of dimensions and directions. Thus the parts of a pipe can be on different levels. When using structural elements 7 that comprise open grooves 8, the structural elements 7 can be installed around a pipe 10 that is bent in a number of dimensions. The structural elements 7 that contain holes 9, on the other hand, cannot be slid around a pipe 10 that is bent in many directions because they would easily get caught on the bends of the pipe.

Methods for making joints in the ends of the pipes 10 are, among others: connection by means of threads, gluing, soldering, pressing, the utilization of thermal expansion, expansion, i.e. swaging, welding and laser welding, as well as metallic and plastic cast pieces and also pipe connectors such as a pipe beading.

FIGS. 7 and 8 present one alternative cooling liquid solution according to the invention. In this solution there are no holes for the cooling liquid pipes inside the structural elements 7, but instead the cooling is made in a separate heat exchanger part, i.e. in an element 12, which is mechanically fixed to the structural elements 7 of the core, the edges of which structural elements comprise grooves 8 that are suitable in their cross-sectional profile. In this solution an aluminium profile is used as a liquid cooling element, which aluminium profile extends to both inside, and to the surface of, the core 1, in which case a greater surface area of cooling contact is achieved for the cooling. A cooling element 12 according to this type of a solution can also cool the winding 3 such that losses are conducted from the winding to the cooling element 12.

In FIG. 7 the heat exchanger part 12 that is formed from aluminium profile with profile technology is detached and in FIG. 8 two heat exchanger parts 12 are fixed to consecutively placed structural elements 7 of the core, of which structural elements 7 only the first one, which is in front of the others, is visible in the figure. The cooling pipes 10 are replaced in this solution with an aluminium profile essentially of the same length as the core 1, with which aluminium profile a larger cooling surface is obtained than with just the pipes 10. The aluminium profile of an element 12 comprises a frame part 14 that transfers heat well, and a pipe-like part 13 that is essentially round in its cross-sectional shape, inside which part 13 there is a hole of the length of the whole element 12 for the cooling liquid. This type of element 12 can also cool the winding 3 such that losses are conducted from the winding 3 to the frame part 14 of the element 12.

The structural elements 7 used in this solution, e.g. presented in FIG. 3, comprise at both ends an essentially round aperture 8 that functions as a part of a duct, the rim of which aperture is open on the outer surface of the end of the structural element 7. The pipe-like part 13 of the aluminium profile of the element 12 and the aperture 8 are dimensioned with respect to each other such that the pipe-like part 13 locks into the apertures 8 of the structural elements 7 placed one after the other or one on top of the other, and the wider frame part remains against the outside edges of the structural elements 7. The length of the aluminium profile of the element 12 is essentially the same or greater than the combined length of the structural elements 7 placed one after the other or one on top of the other, i.e. than the length of the core 1.

From the viewpoint of assembly, it is preferable to use the core structure presented in FIG. 9, which comprises structural elements 7, 7*a* and 7*b* of the core that are of different sizes to each other. The structural elements 7 and 7*a* are provided, on one side, with a groove 8 of e.g. semicircular cross-sectional shape, which grooves 8 when placed against each other form a duct 8*a* e.g. for a cooling liquid pipe 10. Although each structural element 7, 7*a* comprises a groove 8 or a hole 9 made in the manufacturing phase of the structural element 7, 7*a* that extends through the structural element 7, 7*a*, which groove or hole is itself a part of the duct 8*a* intended for the purpose of liquid cooling, a liquid cooling pipe 10 does not, however, necessarily need to be placed into all the ducts 8*a* formed in this way, but instead the quantity of pipes 10 depends on each specific need for cooling. In addition, the center of an assembled core 1 has a space la for the windings 3, which space 1*a* is formed from the structural elements 7, 7*a* and 7*b* when assembling the core 1.

Correspondingly, the structural element 7*b* is flat on all its surfaces. In addition, the structural element 7 is the largest in its cross-section, and the structural elements 7*a* and 7*b* are correspondingly smaller in their cross-section than the structural element 7. The larger structural elements 7 are used e.g. in the corners of the core structure and in places into which the structural elements 7 are easy to install. On the other hand, the smaller structural elements 7*a* and 7*b* are used in the final phase of the assembly of the core, in which phase there is less space around the pipes 10 and the structural elements must be installed perhaps from unfavorable directions.

The idea of assembling the core is that the cross-sectionally small and flat structural element 7*b* is placed into its position by suitably fitting it last of all. In this case the structural elements 7 and 7*a* provided with a groove 8 can be installed more freely into their positions from the best possible direction. This is important so that the thermal paste placed into the grooves 8 of the structural elements 7 and 7*a* stays as well as possible in place when installing a structural element 7*a* and 7 into its position. If the structural elements 7 of the core that are provided with a groove 8 were fitted in the final phase of the assembly into their positions in the direction of the pipes 10, the thermal paste would easily be wiped out of the grooves 8. Also, the thermal paste and the glue in the structural elements 7, 7*a*, 7*b* of the core would foul the pipe 10 and particularly the end of the pipe 10, when making of a joint to the end would be difficult.

The cooling pipes passing through the structure of the core can be separate pipes 10 or they can be manufactured directly into the structural elements 7 of the core 1. The pipes manufactured into the structural elements 7 can be manufactured as a so-called "high-porosity" structure, i.e. as a porous structure through which liquid permeates. The porous material can only be on the edges of the pipes or on the whole area of a pipe. This type of high-porosity structure efficiently transfers heat from the core 1 into the cooling liquid, because the flow inside it is easily rotational i.e. turbulent. Likewise the inner surface area of the pipe made from porous material, i.e. the surface area contributing to heat transfer, is large. When using separate pipes 10 they can be provided with separate turbulators, such as e.g. with spirals, which make a laminar flow turbulent even at a low flow speed, in which case the transfer of heat from the pipe 10 into the cooling liquid becomes more efficient. This type of effect is also achieved with separate shapes, such as tubercles or rifles, made on the inner surface of the pipes 10. It is best to coat a high-porosity structure with a coating that prevents corrosion, such as with an aluminium or nickel coating. Separate pipes 10, the aforementioned high-porosity structure or other duct structures form, either together or separately, the liquid duct structure 2 of the core 1 presented in FIG. 1.

Any magnetic material whatsoever can be used as the core material. It is, however, preferable to use core material that is based on metal powder instead of a laminate-based material because it keeps its inductance up to a higher frequency than silicon steel laminate.

In the choke according to the invention, there can be liquid cooling pipes 10 both in the horizontal beams and in the vertical pillars of the core 1. The horizontal beams and the vertical pillars are defined such that when the choke is in its basic position on the base at least one horizontal beam is in the bottom part of the choke and one horizontal beam is in the top part of the choke. In a 3-phase choke, three vertical pillars that are essentially perpendicular with respect to the horizontal beams are between the horizontal beams, around which vertical pillars the windings are wound. In practice, the choke can be in such a position that the horizontal beams are not horizontal and the vertical pillars are not vertical, but for the sake of simplicity these elements are hereinafter referred to as horizontal beams and vertical pillars.

When the pipes 10 are installed into suitable locations, it is possible to get the pipes 10 that are in the horizontal beams and vertical beams to pass overlapping each other in the finished choke. U-shaped pipes are used in the vertical pillars and in the horizontal beams, in which case the joints are placed at the same end and there are fewer of them than if, instead of U-shaped pipes, there were two straight, i.e. I-shaped, pipes with connectors at both ends. It is advantageous to make the core 1 from a number of smaller parts that settle in connection with each other or overlapping each other in the assembly phase.

The winding that will go around the core can be made e.g. with busbars, with wire, with planar connected plates, with cables or with conductor foil. Especially when using cables, they can be efficiently pressed tightly into the cores 1, in which case they cool via the cores 1 into the cooling liquid. When using cables, also more than one winding turn can easily be produced and by placing a suitable quantity of cables in parallel a sufficient conductor surface area for each current value can be obtained. In addition, the insulation of the cables takes care of the insulation of electrical parts, in which case disruptive discharge problems caused by accretion typical to busbar solutions are not able to occur. In this way e.g. a dUdT filter can be made such that liquid cooling is integrated into the core 1 and the winding 3 is made with cables, which are cooled against the core 1 that is cooled with liquid.

When using the essentially flat winding layers 4 presented in FIG. 1 liquid cooling heat exchangers 5, in which cooling liquid circulates, are placed between the winding layers or on their outer surfaces. Also the winding plates 4 themselves could be designed such that they function as heat exchangers i.e. liquid could pass directly between the winding layers 4, or even inside the winding layers 4. However, when using separate heat exchangers 5 insulated from the winding plates 4, impurities can to some extent be allowed into the cooling liquid, because placing the liquid circulation directly into the windings would require use of a cooling liquid that is not electrically conductive. In practice there is no need to place a heat exchanger 5 between each winding plate 4, but instead only such that the hottest point of the structure remains at a suitable temperature.

When the liquid heat exchangers 5 of the structure according to FIG. 1 are connected to earth via the cooling liquid, passage over the winding 3 of the field connected capacitively over the ends of the winding 3 is prevented at the same time, which reduces common-mode interference current. The winding layers 4 are insulated from each other and from the heat exchangers 5 with insulators, which also conduct heat to some extent. The transfer of heat between the layers can be improved by placing thermal paste in the contact points of the layers or by using insulators, such as Sil-Pad mats, intended especially for thermal conductance and for making good contact between surfaces, as insulators between the layers. Different insulators can be used between different layers, because better thermal conductivity often means a more expensive price and one cost-effective option would be to place an insulator that conducts heat better only between the heat exchanger elements 5 and the first winding layers 4, because power dissipation occurs mostly on this interface. The heat exchanger elements 5 can also be coated with special thermally conductive insulators. Likewise the winding layers 4 can be coated with thermally conductive insulators.

FIGS. 10 and 11 present two winding plates 15 intended for a winding, which winding plates are mirror images of each other when turned around the longitudinal axis of the winding plate 15. The winding plate 15 is essentially of an angular O-shape. Stacking such winding plates 15 one on top of the other and turning every second plate in the horizontal plane creates a continuous winding structure when the plates are suitably connected to each other and insulated from each other. The points of connection are in the bottom part in FIGS. 10 and 11. A number of turns can be made with the winding plates 15 in one layer before moving to the next layer.

The winding plates 15 can be of different lengths and they can be manufactured by water cutting or laser cutting, in a plate machining center or by punching with a follow-on tool. Manufacturing the plates from aluminium, in particular, is cost-effective. In addition, the material best suited for each specific environmental condition can be selected. Additionally, the winding plates 15 can be connected to each other e.g. by screwing, riveting, cold soldering, pressing or welding.

FIG. 12 presents a simplified structure of one planar liquid cooling element 16 of a winding 3. The liquid cooling element 16 comprises lid plates, center plates and base plates 17-19. When the plates are connected to form a stack, a space 20 is formed in between them to act as a flow chamber for the liquid, which space functions as the cooling duct 6 presented in FIG. 1. A liquid cooling element 16 can also be manufactured by other methods, such as aluminium profile extrusion technology or by soldering out of thin plates. The center plate 18 forming a flow chamber 20 of the liquid can be made of a different material than the other parts 17 and 19 of the element. In this case e.g. the center plate 18 can be wholly or partly of sealing material. With the structure according to FIG. 12 the heat exchanger can be most efficiently implanted into a stacked winding structure 3. The structure according to FIG. 12 can also be used as a winding by adding suitable fixing elements between the layers.

At its simplest a liquid cooling heat exchanger or a liquid cooling element 16 can be an object 21 essentially of rectangular shape, as presented sectioned at the end and side in FIG. 13, which object comprises a space 22 in the center, such as a hole or holes for the passage of the cooling liquid, in the longitudinal direction of the object. These types of cooling elements 16 can be effectively manufactured particularly with profile technology.

FIG. 14 presents a winding element 23 of a winding 3 stacked of winding plates 15, in which winding element the winding plates 15 are placed between the liquid cooling elements 16. Correspondingly, FIG. 15 presents a whole 3-phase choke 24, in which the winding structure is assembled from a number of liquid-cooled winding elements 23. In this solution the core is not cooled, but it could be cooled with liquid by utilizing the holes 9 or the grooves 8 in the structural elements 7 of the core 1 for installing liquid cooling pipes 10. The liquid circulation can also be just in the core 1, in which case the windings 3 can be cooled into the core 1.

Individual winding plates can also be composed of a number of thinner plates stacked one on top of the other. This may need to be done due to, among other things, the limitations of manufacturing technology. Also from the viewpoint of high-frequency operation it is advantageous to make a winding layer from a number of thinner plates, because with high frequencies current flows only on the surface of the plates and a number of thinner plates have a larger combined surface than one thick plate. It is possible to line this type of a filter completely with thermal insulation, in which case the heat to be transferred to the surrounding air can be almost completely eliminated.

These types of manufacturing methods can be used to manufacture transformers, chokes and filters. The capacitors of filters can also be cooled, e.g. into cooling elements 5 that are integrated into the windings, which elements are also called "cold plates". For this purpose different shapings or additional parts can be made for the cooling elements 5. Chokes made with this technology can also be placed one on top of the other, in which case they are fitted to use shared liquid cooling pipes 10. Such a structural solution can be e.g. an LCL filter that has two chokes. The solution according to the invention is suited to the manufacturing of both single-phase and polyphase chokes.

It is also possible to perform a so-called "hybrid cooling", in which the core is cooled with integrated liquid cooling and the winding is made by stacking the plates one on top of the other and leaving a thin gap between them for the passage of cooling air. Air is blown into the winding with a fan. Thus extremely effective cooling is brought about, because both cooling liquid and cooling air are generally available in all installation sites.

FIG. 16 presents one liquid-cooled choke according to the invention as viewed from the first end of the structure, simplified and partly spread open in the vertical direction. For the sake of clarity, only the points of the winding plates that are in contact are presented. The concealed second end can be different e.g. such that there all the winding plates 15 are of the same width and they are placed centrally one on top of the other such that there are no large gaps or no gaps at all between the plates.

The first end visible in FIG. 16 comprises the contacts of the winding plates 15 and therefore there must be more space between the winding plates, e.g. for the heads of the fixing means 27, such as screws or rivets. Each winding layer 25 comprises two winding plates 15 and each layer forms one turn and the layers are insulated from each other everywhere else except at their contact points. In order to achieve low contact resistance, all the winding plates 15 intended to be connected are ground to remove the oxide layer and pressed together and riveted, bolted or otherwise connected at two different locations, in which case a large contact area is formed. The two topmost and bottommost winding plates 15*i* of the structure extend in the inside direction to a different distance than the inner winding plates 15, in which case there is a suitable space between the different winding layers 25, in which space an insulator 29 can pass and bend. Likewise there is space on the surfaces of the structure for the heads of the rivets.

Liquid cooling elements 16 are placed at suitable points between the winding layers 25, the winding plates 15j below and above which liquid cooling elements comprise at the first end additional protrusions 26 pointing towards the center line of the plates, which protrusions are bent obliquely either upwards or downwards so that the winding plate layers 25 can be connected to each other over the liquid cooling elements 16. In this case the protrusions 26 in the winding plates of the winding layer 25 that are above the liquid cooling element 16 are bent downwards and the protrusions 26 in the winding plates of the winding layer 25 that are below the liquid cooling element 16 are bent upwards. The connection is made by connecting the downward-bent and the upward-bent protrusions 26 to each other with fixing means, such as rivets or bolts. Bypassing the liquid cooling elements 16 can also be implemented in other ways, such as by placing a conductor piece at this point of the winding, which piece is of the same thickness as the liquid cooling element.

The ends of the liquid cooling elements 16 comprise branch couplings 28 of the liquid ducts, by means of which branch couplings the liquid cooling elements are connected to each other for implementing the circulation of cooling liquid. For the sake of clarity, the cooling tubes connected to the branch couplings 28 are not shown in FIG. 16.

FIGS. 17-20 present one winding structure of a winding 3 of a choke according to the invention in different phases of assembly and viewed from different directions. The winding structure is composed e.g. of the winding plates 4 or 15 described above. The thickness of an individual plate 4 is e.g. 4 mm and the plates are stacked into one layer, one on top of the other, always three at a time for achieving a suitable current endurance. These types of symmetrical plate packs are stacked one on top of the other and they are turned on the horizontal plane such that the packs are connected to each other and are isolated from each other suitably, in which case the desired number of winding turns is created. Heat exchangers 5, in which cooling liquid flows and which function as liquid cooling elements, are placed at suitable gaps. This kind of assembled pack is pressed together with the fixing bars 29 and 30, which also interposition the winding plates 4, the insulators 21 and the liquid cooling elements 5. When the bars 29 and 30 compress the structure, electrical contacts and heat transfer contacts between the different layers are created at the same time. In this case e.g. the bars 29 are specifically for heat transfer contacts and the bars 30 for electrical contacts. The bars 29 and 30 are insulated from the winding plates by means of insulator pipes 32.

The compression structure of the winding 3 comprises a mechanism, such as e.g. spring washers 31 in connection with each bar 29, 30, which mechanism eliminates the effect of thermal expansion on the compression of the contacts. In the liquid cooling elements 5, the liquid flows into the winding structure via a connector 33 in the first end of the element, turns around at the other end of the winding element and comes back out from the connector 34 that is in the first end of the winding element, in which case all the external liquid connections 33, 34 of the liquid cooling element 5 are at the same end, i.e. at the first end of the structure. In this case the cooling tubes connected to the structure take up space only at the first end of the structure. The interface of layers comprises preferably thermal paste for improving the transfer of heat. Preferably e.g. SIL-PAD insulation material is used for the insulation of the liquid cooling elements 5.

FIGS. 21-23 present the structure of a core 1 that is assembled from the structural elements 7, 7*a* and 7*b* of a 3-phase choke according to the invention. FIG. 21 presents the core structure 1 of a 3-phase choke in the assembly phase of the core, FIG. 22 presents a top view of the top beam 36 of the choke, and FIG. 23 presents a corresponding core structure when assembled.

It is advantageous to assemble the core structure 1 such that suitable subassemblies are assembled first, which subassemblies are e.g. vertical poles or pillars 35, a partially-assembled top horizontal beam 36 and a partially-assembled bottom horizontal beam 37. These subassemblies are presented as detached in FIG. 21. The cooling liquid pipes 10 are installed into the subassemblies already before the final assembly of the core 1, in which case installation of the cooling liquid pipes is easy.

The core 1 of a three-phase choke comprises three vertical pillars 35 assembled from small structural elements 7 and/or 7*a* and/or 7*b* of different shapes and different sizes, as well as a top horizontal beam 36 and a bottom horizontal beam 37 assembled from the structural elements 7 and/or 7*a* and/or 7*b*, all of which comprise their own separate cooling liquid circulations. Additionally, the cooling pipes 10 of the cooling liquid circulations are fitted into the vertical pillars 35 and into both the top horizontal beams 36 and the bottom horizontal beams 37 such that the cooling liquid pipes 10 pass in the vertical pillars 35 and in both the top horizontal beams 36 and the bottom horizontal beams 37 crosswise and overlapping each other. Separate cooling liquid circulations facilitate the assembly of the choke.

The horizontal beams 36 and 37 consist of even smaller subassemblies. In this case the bottom horizontal beam 37 comprises two neck parts 38 on the side, which contain a cooling pipe 10, and two rectangularly-shaped intermediate beam parts 39, which intermediate beam parts 39 are placed between the neck parts 38 in the finished assembly. Correspondingly, the top horizontal beam 36 comprises a basic beam 40 as well as additional structural parts to be installed in the final phase of installation around the cooling pipes 10 of the vertical pillars 35, which additional structural parts are at least suitably sized and shaped structural elements 7 as well as structural elements 7*a* and 7*b* that are smaller than the structural elements 7, of which the structural elements 7 and 7*a* comprise a groove 8 for the cooling pipe, but the structural elements 7*b* are flat on all their sides.

The liquid pipes 10 in the vertical pillars 35 form a U-bend in the bottom part of the vertical pillars 35. When performing the assembly, the different subassemblies settle overlapping each other to form a fixed, uniform structure when the parts are placed into their position and the structure is pressed together. The subassemblies are built up like a brick wall, in which case the structure becomes sturdy. The core structure comprises vertical and horizontal liquid pipes 10 that pass overlapping each other. The liquid pipes 10 of the vertical pillars 35 can be put through the top horizontal beam 36 when some of the structural elements are initially left out of the top horizontal beam 36, in which case the basic beam 40 of the top beam 36 comprises apertures 47 at its ends and apertures 48 in the centre for the lead-ins of the pipes 10 of the vertical pillars 35. Only when the pipes 10 of the vertical pillars 35 have been put through the apertures 47 and 48 are the smaller structural elements 7, 7*a* and 7*b* placed in their positions in the apertures 47 and 48 around the pipes.

In this case e.g. a smaller structural element 7*a* is carefully threaded between the pipe 10 and the closed end of the aperture 47 in the basic beam 40, which aperture is open at one of its ends, which structural element 7*a* contains thermal paste in the groove 8 that is on its side surface on the pipe side, and the surfaces of which structural element 7*a* that are intended to be glued contain glue. The structural element 7*a* is carefully threaded into its position downwards from above and at the same time the end of the pipe 10 is carefully bent towards the free end of the aperture 47, in which case the space between the closed end of the aperture 47 and the pipe 10 increases and the structural element 7*a* is easily brought into its position so that neither the thermal paste nor the glue stains the pipe 10. When the pipe 10 is released to return to its normal position, the pipe 10 settles into the groove 8 of the structural element 7*a*. After this a larger structural element 7, the groove 8 of which has been provided with thermal paste and the surfaces of which that are intended to be glued contain glue, is carefully pushed into the aperture 47 essentially in the horizontal direction from the open end of the aperture 47 and finally lowered onto the structural element below and pushed tight against the pipe 10. Thus the pipe 10 can be firmly enclosed between the structural elements 7 and 7*a*.

Correspondingly, the smaller structural elements 7*a* provided with a groove 8 are first threaded into the aperture 48 that is in the center of the basic beam 40, the length of which aperture 48 is greater than the combined length of two small structural elements 7*a*, around the pipe 10, the groove of which smaller structural elements contains thermal paste and the surfaces of which smaller structural elements that are intended to be glued contain glue. Threading of the small structural elements 7*a* occurs e.g. such that the structural elements 7*a* are first lowered downwards into the aperture 48 at a suitable horizontal distance from the surface of the pipe 10 and when the structural element 7*a* is almost at its destination in the vertical direction it is moved in the lateral direction tight against the pipe 10 such that the pipe 10 settles into the groove 8. This is also done in the same aperture 48 on the other side of the pipe 10. After this the structural pieces 7*b*, which function as filler pieces, are placed in the aperture 48, behind the structural pieces 7*a*. As many structural pieces 7*b* are placed into the aperture 48 as needed to fill the aperture 48 sufficiently.

FIGS. 24 and 25 present one 3-phase choke according to the invention. In FIG. 24 the choke is in the assembly phase and in FIG. 25 it is fully assembled. The choke comprises at least windings 3, a core 1, support mechanics and liquid circulation components. The support mechanics comprises at least a base plate 45, support beams 43 and 44, and a tightening mechanism 42. The entire choke is constructed on top of the base plate 45, which base plate 45 comprises lateral guide means for the bottom horizontal beam 37 of the core. The support beams 43 and 44 are U-beams in cross-section, opening outwards to the side, which beams are placed on the sides of the top horizontal beams 36 and the bottom horizontal beams 37 and which comprise fixing holes for fixing the fixing bars 29 of the windings 3. Correspondingly the tightening mechanics 42 is arranged to press the top horizontal beams 36 and the bottom horizontal beams 37 against each other by means of suitable compression pieces. This makes the structure rigid, which reduces noise. The cooling liquid circulation is implemented with manifolds 41 and tubes. For the sake of clarity, the tubes are not shown in FIGS. 24 and 25. The tubes can be freely connected between the connectors 33 and 34 that are in the liquid pipes 10, manifolds 41, cooling elements 5 and the cores 1 for implementing an appropriate cooling liquid circulation at any given time.

FIGS. 26 and 27 present a diagrammatic and simplified side or top view of two core structures 1 assembled from different structural elements, and the temperatures of the structural elements 7 placed in different points of the core structures when the inductive component is in operation.

The upper core structure 1 in FIG. 26 is manufactured from structural elements 7 that are similar in terms of their material, which core structure comprises cooling ducts 2 in the edgemost structural elements and the other structural elements are without cooling ducts. For the sake of clarity the structural elements 7 are numbered starting from the edge of the core structure 1 such that the edgemost element is no. 1, the next element is no. 2, and the centermost element of a core structure comprising five structural elements is no. 3. The core structure 1 is a symmetrical structure in relation to its center line. When in operation, the structural element no. 3 in the center of the core structure heats up the most because from it is the longest distance to the cooling duct 2. The heat flow is marked in the figure with an arrow. Presented here is only a simplified core structure. In reality there can be more than five consecutive structural elements.

Correspondingly, the lower core structure 1 in FIG. 26 is manufactured from structural elements 7 that are different in terms of their material, such that all the other structural elements 7 are similar to each other, and also similar to those in the upper core structure, in terms of their material, but the centermost structural element no. 3, which usually heats up the most, is of a lower-loss material than the other structural elements.

According to the invention it is advantageous in principle to use one material in the structural elements 7 forming the core structure 1, but if too high a temperature were to form in the center of the core, a part of the material in principle used is replaced with a lower-loss material in the center of the core structure 1. Since each structural element 7 is preferably of only one material, the replacement is implemented one structural element 7 at a time such that the centermost structural element or structural elements 7 is/are of a lower-loss material than the structural elements that are nearer the edge of the structure.

FIG. 27 presents one example of the differences of the temperatures of the core structures according to FIG. 26. The curve marked with a circle (All core parts of same material) presents the cooling of the upper core structure 1 of FIG. 26 one structural element 7 at a time, and the curve marked with a square (Low loss material in the middle) presents the cooling of the lower core structure 1 of FIG. 26 one structural element 7 at a time.

When the losses of all the structural elements 7 are 10 W, the temperatures of the structural elements in a certain operating situation settle so that the temperature in the cooling duct 2 is approx. 50°, in the edgemost structural element no. 1 approx. 80°, in the structural element no. 2 approx. 100°, and in the hottest, i.e. in the centermost structural element no. 3 approx. 110°. Correspondingly, the temperatures of the structural elements of the lower core structure 1 presented in FIG. 26 in the same operating situation settle so that the temperature in the cooling duct 2 is again approx. 50°, in the edgemost structural element no. 1 approx. 75°, in the structural element no. 2 approx. 90°, and in the hottest, i.e. in the centermost structural element no. 3, which structural element is of lower-loss material than the other structural elements of the same core structure 1, the temperature is approx. 95°. From this it can be seen that when the losses of the centermost structural element/elements are smaller, the temperatures of the other structural elements of the core structure also decrease correspondingly because all the loss is conducted through the structural elements 7 into the cooling duct 2.

With the method according to the invention, an inductive component is manufactured e.g. as follows:

The core 1 of the inductive component is manufactured from a number of smaller structural elements 7, 7*a*, 7*b* that are essentially both different and similar to each other, which structural elements are assembled to form a packet of the size and shape of the core 1 designed for the application, e.g. such that subassemblies are made first, which are separately composed of e.g. vertical pillars 35, a top horizontal beam 36 and a bottom horizontal beam 37, and cooling liquid pipes 10 are placed in at least a part of the subassemblies before final assembly of the subassemblies into the core structure. Any magnetic material whatsoever can be used as the material of the structural elements 7, 7*a*, 7*b*. According to the invention, core material based on metal powder is used as the material. A structural element 7, 7*a*, 7*b* is manufactured e.g. from metal powder by pressing such that the structural element 7, 7*a*, 7*b* is pressed into an essentially rectangularly-shaped piece, in which all the sides are essentially right-angled. In connection with the pressing phase a groove 8 or hole 9 that passes in one direction through the structural element is also formed in the structural element 7, 7*a* for the use of the cooling liquid. The groove 8 in the structural element 7, 7*a* is cross-sectionally essentially e.g. semicircular, becoming a full circle when two structural elements 7 and/or 7*a* provided with a similar groove are placed against each other in the assembly phase of the core 1.

In the assembly phase of the core 1 of an inductive component, such as of a choke, the structural elements 7, 7*a*, 7*b* are placed consecutively one after the other and, if necessary, side-by-side and one on top of the other such that the grooves 8 of the structural elements 7, 7*a* in at least one direction form an essentially straight duct 2, 8*a*, extending essentially through the whole core 1, for the purpose of liquid cooling.

Correspondingly, in the assembly of the core 1 the structural elements 7*b* that have flat surfaces are placed essentially last in the core to be assembled, which structural elements are preferably smaller in their cross-section than the largest structural elements 7 that are provided with grooves 8.

Cooling liquid pipes 10 or corresponding pipe-like means are placed into the ducts 2, 8*a* formed in the assembly phase of the structural elements 7, 7*a* of the core 1. Thermal expansion is utilized, if necessary, in the installation such that the pipe 10 or corresponding pipe-like means is cooled before being placed into the duct 2, 8*a*. The tolerance-air gap between the pipe 10 and the duct 2, 8*a* is filled, if necessary, with a paste that conducts heat, such as with a 2-component paste. After this the pipes 10 that have been installed into the cores 1 are connected to each other to form a continuous liquid circulation by means of the end plates 11 provided with liquid ducting, and/or by means of connectors 33, 34 and/or tubes.

Another method to manufacture a liquid-cooled inductive component is to assemble the liquid circulation with pipes and possible end plates 11 first, after which the structural elements 7, 7*a* provided with semicircular grooves 8 are assembled around the finished piping to form a packet of the size and shape of the core 1 designed for the application.

To improve the efficiency of the cooling, the pipes 10 are provided, if necessary, with separate turbulators, such as e.g. with spirals or with corresponding means that produce a turbulent flow, such as tubercles or rifles, all of which are placed inside the pipes 10.

An aluminium profile 12 is used as a liquid cooling element, if necessary, in addition to or instead of the pipe 10. The structural elements 7 that form the core 1 are assembled consecutively to each other around the pipe part 13 in connection with the aluminium profile 12.

Yet another way to implement liquid cooling is to manufacture the cooling piping as parts directly inside the structural elements 7 in the pressing phase of the structural elements. This type of cooling piping is constructed as e.g. a so-called "high-porosity" structure, i.e. as a porous structure through which liquid permeates. The porous material is formed in the pressing phase either only on the edges of the pipes or on the whole area of a pipe. When the structural elements 7 manufactured in this way are assembled together to form one pack in the manufacturing phase of the core 1, the holes of the structural elements 7 set consecutively settle into a straight row one after another and thus form a ready pipe or duct. The surfaces of the structural elements 7 that touch each other are sealed to each other, e.g. by gluing, so that the cooling liquid is not able to leak from the gaps between the structural elements 7.

It is obvious to the person skilled in the art that different embodiments of the invention are not limited to the examples described above, but that they may be varied within the scope of the claims presented below.

It is also obvious to the person skilled in the art that the liquid cooling pipe can also pass in the area between the core and the winding, simultaneously cooling both of them.

It is further obvious to the person skilled in the art that the winding plates and the heat exchangers of the winding can also be round in shape. Round shapes and geometry can be used e.g. to limit the forces of short-circuited currents.

The invention claimed is:

1. A liquid cooled inductive component, comprising:

a winding structure comprising a plurality of winding layers, each of the winding layers comprising a plurality of stacked winding plates, and at least one liquid cooling structure disposed between adjacent ones of the winding layers;

a magnetic core passing through openings in the stacked winding plates and formed from at least two different types of polyhedral structural elements joined together to form the core; and a cooling liquid pipe which is located in a cooling duct passing through and/or between at least some of the polyhedral structural elements of the core, the cooling liquid pipe being thermally coupled to the core.

2. An inductive component according to claim 1, wherein the cooling duct is formed by an essentially round hole in one or more of the structural elements.

3. An inductive component according to claim 1, wherein the cooling duct is formed by grooves of face-to-face placed ones of the structural elements.

4. An inductive component according to claim 1, wherein the cooling pipe has bendings such that the cooling pipe goes through the core several times.

5. An inductive component according to claim 1, wherein the cooling pipes of vertical pillars and the cooling pipes of horizontal beams pass each other crosswise.

6. An inductive component according to claims 1, wherein the cooling duct positioning and quantity are based on size, shape and positioning of the structural elements.

7. An inductive component according to claim 1, wherein the structural elements are of different magnetic materials.

8. The inductive component according to claim 1, wherein the winding plates of the winding structure and the at least two different types of polyhedral structural elements of the core are modular components configured to be used in different combinations and/or numbers to support construction of a variety of different inductive component configurations.

9. The inductive component according to claim 1, wherein the at least two different types of polyhedral structural elements comprise at least three different types of polyhedral structural elements.

10. the inductive component according to claim 1, wherein the at least two different types of polyhedral structural elements include at least one type of polyhedral structural element having a feature therein configured to accept a cooling pipe and at least one type of polyhedral structural element lacking any feature configured to accept a cooling pipe.

11. The inductive component according to claim 1, wherein the at least two different types of polyhedral structural elements differ in size in at least one dimension.

12. A method of manufacturing a liquid cooled inductive component, the method comprising:

assembling a magnetic core by joining together at least two different types of polyhedral structural elements;

assembling a winding structure comprising a plurality of winding layers, each winding layer comprising a plurality of stacked winding plates, and at least one liquid cooling structure disposed between adjacent ones of the winding layers;

positioning the winding structure on the core such that the core passes through openings in the stacked winding plates; and equipping the core with at least one cooling liquid pipe which is placed in at least one cooling duct passing through and/or between at least some of the polyhedral structural elements of the core such that the at least one cooling pipe is thermally coupled to the core.

13. A method according to claim 12, wherein the at least one cooling duct is formed by an essentially round hole in one or more of the structural elements.

14. A method according to claim 12, wherein the at least one cooling duct is formed by grooves of face-to-face placed structural elements.

15. A method according to claim 12, further comprising bending the at least one cooling pipe such that the at least one cooling pipe goes through the the core several times.

16. A method according to claim 12, wherein the structural elements comprise different magnetic materials.

17. The method of according to claim 12, wherein the winding plates of the winding structure and the at least two different types of polyhedral structural elements of the core are modular components configured to be used in different combinations and/or numbers to support construction of a variety of different inductive component configurations.

18. The method according to claim 12, wherein the at least two different types of polyhedral structural elements comprise at least three different types of polyhedral structural elements.

19. The method according to claim 12, wherein the at least two different types of polyhedral structural elements include at least one type of polyhedral structural element having a feature therein configured to accept a cooling pipe and at least one type of polyhedral structural element lacking any feature configured to accept a cooling pipe.

20. The method according to claim 12, wherein the at least two different types of polyhedral structural elements differ in size in at least one dimension.

* * * * *

UNITED STATES PATENT AND TRADEMARK OFFICE

CERTIFICATE OF CORRECTION

PATENT NO. : 9,251,947 B2
APPLICATION NO. : 13/381066
DATED : February 2, 2016
INVENTOR(S) : Salomäki It is certified that error appears in the above-identified patent and that said Letters Patent is hereby corrected as shown below:

In the Specification:
Column 14, Lines 22-23: delete "with pipes and possible" and insert -- with pipes 10 and possible --

In the Claims:
Column 15, Claim 1, Line 5: delete "lavers;" and insert -- layers; --
Column 15, Claim 10, Line 41: delete "the" and insert -- The --
Column 16, Claim 15, Line 26: delete "through the the core" and insert -- through the core --

Signed and Sealed this
Ninth Day of August, 2016

Michelle K. Lee

Michelle K. Lee
*Director of the United States Patent and Trademark Office*